US007497792B2

(12) United States Patent
Hutton

(10) Patent No.: US 7,497,792 B2
(45) Date of Patent: Mar. 3, 2009

(54) LACROSSE TRAINING DEVICE

(76) Inventor: Kenneth S. Hutton, 842 Olde Hickory Rd., Lancaster, PA (US) 17601

( * ) Notice: Subject to any disclaimer, the term of this patent is extended or adjusted under 35 U.S.C. 154(b) by 202 days.

(21) Appl. No.: 11/556,380

(22) Filed: Nov. 3, 2006

(65) Prior Publication Data

US 2007/0060419 A1 Mar. 15, 2007

Related U.S. Application Data

(63) Continuation-in-part of application No. 11/033,419, filed on Jan. 11, 2005, now abandoned.

(51) Int. Cl.
*A63B 69/00* (2006.01)

(52) U.S. Cl. ..... 473/422; 473/441; 473/438; 473/445

(58) Field of Classification Search ..... 473/422, 473/446, 441, 438, 445; 273/317.1, 317.2, 273/108.1, 108.2
See application file for complete search history.

(56) References Cited

U.S. PATENT DOCUMENTS 1,173,818 A * 2/1916 Lins ..... 273/317.2
1,493,934 A * 5/1924 Grau et al. ..... 273/317.2
1,561,178 A * 11/1925 McGrann ..... 273/108.21
2,824,742 A 2/1958 Fortin
5,156,402 A 10/1992 Hart
5,769,742 A * 6/1998 Bristow ..... 473/446
5,807,185 A * 9/1998 Raubuck et al. ..... 473/229
5,957,788 A 9/1999 Eze
6,261,194 B1 * 7/2001 Hadar et al. ..... 473/441
6,322,461 B1 * 11/2001 Walsh ..... 473/422
6,413,196 B1 * 7/2002 Crowson ..... 482/118
6,575,852 B2 * 6/2003 Orner ..... 473/438
6,942,585 B1 * 9/2005 Krause ..... 473/445
7,070,521 B2 * 7/2006 Bayduke ..... 473/438
7,147,579 B2 * 12/2006 Forrest ..... 473/441

* cited by examiner

*Primary Examiner*—Mitra Aryanpour
(74) *Attorney, Agent, or Firm*—Dale J. Ream

(57) ABSTRACT

A training device for use by a lacrosse player to practice checking an offensive player includes a main post extending upwardly from a base. An arm is operatively coupled to the main post and rotatable about a fixed point intermediate its proximal and distal ends. The arm includes a wrist near its distal end for holding a lacrosse stick. An activating member is mounted to the main post for separating a user from the arm's distal end. An actuator is coupled to the arm's distal member and to the activating member such that the arm is caused to move when a user attacks the activating member. The actuator may include rack and pinion gears for translating a linear force upon the activating member into a rotational force upon the arm. A spiral spring and cam provide for oscillating movement of the arm.

18 Claims, 5 Drawing Sheets

LACROSSE TRAINING DEVICE

RELATED APPLICATIONS

The present application is a continuation in part of U.S. patent application Ser. No. 11/033,419, filed 11 Jan. 2005 now abandoned and titled "LACROSSE TRAINING SYSTEM", which is incorporated herein by reference.

BACKGROUND OF THE INVENTION

The present invention relates to devices for training and practicing the sport game of lacrosse. More particularly, this invention relates to a lacrosse training device for use by a lacrosse player to practice checking an offensive player.

Lacrosse is a spring and summer team sport of Native American origin played with netted sticks called crosses. The world's first official game was played at patrician Upper Canada College in 1867. Today, lacrosse is played internationally as a 12 person per side game for women and as a 10 person per side game for men with differences in playing rules and equipments. The field of play is approximately 110 yards (100 m) long and 40 yards (37 m) wide. The goals are 6 feet (1.8 m) by 6 feet and contain a mesh netting similar to an ice hockey goal. The principle of the game is to project a small solid rubber ball into the opposing team's goal with a crosse (lacrosse stick) which is usually made of wood with a shaped net pocket at the end.

The players on a team each carry a crosse, and are arranged by position as offensive players called "attackmen", "midfielders" or "middies", "defensemen", and a single goaltender, or "goalie." The attackman's responsibility is to score goals. Players scoop the ball off the ground and hurl the ball in the air to other players. Players are allowed to run carrying the ball with their stick. In men's lacrosse, players may kick the ball, as well as cover it with their sticks. Play is typically quite fast, and resembles a combination of soccer, basketball and field hockey. Players are permitted to hit one another with their bodies and sticks, although some rules govern the manner in which this may be done. Therefore players are protected by wearing helmets and heavy padded gloves.

Lacrosse players need to master several different skills to compete in the game such as:

- Catching and cradling—holding the ball in the stick pocket;
- Cutting—a movement by an offensive player without the ball toward the opponent's goal, in anticipation of a feed and shot;
- Feeding and passing—passing the ball to a teammate who is in position for a shot on goal;
- Scooping—an act of picking up a loose ball with the crosse;
- Screening, Shooting, etc; and most importantly
- Checking, a defensive technique in which a series of short, sharp, controlled strikes to an opponent's stick is used to force a player carrying the ball to drop it. There are different types of checking such as Poke Check—a stick check in which the player pokes the head of his stick at an opponent's stick through the top hand by pushing with the bottom hand, Slap Check—a stick check in which a player slaps the head of his stick against his opponent's stick and Wrap Check—a one-handed check in which the defender swings his stick around his opponent's body to dislodge the ball.

There are no available training devices in the market specially designed for lacrosse checking skills practice. Coaches and players usually resort to the traditional one-on-one checking practice where one player acts as an opponent holding the ball in his/her crosse pocket while the other player tries to dislodge the ball. The key problem of this method is that individual practice is impossible.

During checking moves, opposing players usually engage in a "reverse" tug-of-war situation where each player is trying to fend off the other by pushing against the other. In order to increase strength and stamina, some players use sleds that are designed for football practice. However, these sleds are not designed for lacrosse training and henceforth are not very effective.

Therefore, it would be desirable to have a lacrosse training device for use by a single player to practice checking an offensive player, i.e. for use with or without a partner. Further, it would be desirable to have a lacrosse training device that simulates random movement of a lacrosse stick of an offensive player. In addition, it would be desirable to have a lacrosse training device in which the user may adjust its height, the length of the arm, the weight of the base, and may activate the arm's movement when ready.

SUMMARY OF THE INVENTION

Therefore, a lacrosse training device for use by a lacrosse player to practice checking an offensive player according to the present invention includes a base and a main post extending upwardly from the base. An arm is operatively coupled to the main post and extends outwardly therefrom, the arm being rotatable about a fixed point between proximal and distal ends of the arm. A lacrosse stick may be attached to a distal end of the arm. An activating member is operatively coupled to the main post and extends outwardly, the activating member being configured to separate a user from the distal end of the arm. An actuator is coupled to the proximal end of the arm and activating member and translates linear movement of the activating member into non-linear movement of the arm. In other words, when a user pushes against the actuator, the activating member causes the arm to begin to rotate.

The activating member includes a generally vertical padded wall that the user may attack. The arm includes a flexible wrist having resilient material allowing irregular three-dimensional movement of the distal end of the arm when the arm is moved by the actuator. The actuator itself may include a rack gear defined by the activating member and a pinion gear having a configuration complementary to that of the rack gear such that linear movement of the rack gear causes rotational movement of the pinion gear. A spiral spring connected to the pinion gear is coupled to a cam for causing the arm to move in an oscillating manner. Accordingly, when actuated by a user, the arm will rotate which may also cause the wrist to move the lacrosse stick in an irregular three-dimensional movement as well as to oscillate the arm. The user may reach around the activating member and main post with his own lacrosse stick to practice checking an offensive player, and to practice contacting the device's lacrosse stick until the energy from the spring is dissipated.

Therefore, a general object of this invention is to provide a training device for use by a lacrosse player to practice checking an offensive player.

Another object of this invention is to provide a training device, as aforesaid, that may be used by a single lacrosse player or multiple players.

Still another object of this invention is to provide a training device, as aforesaid, in which height, length, and weight of various device components are adjustable.

Yet another object of this invention is to provide a training device, as aforesaid, in which a simulated arm of an offensive player may be actuated to rotate, oscillate, and provide irregular three-dimensional movement when a user attacks/presses a padded member.

A further object of this invention is to provide a training device, as aforesaid, that provides lower body training as well as lacrosse stick checking training.

A still further object of this invention is to provide a training device, as aforesaid, that requires no electric power to operate.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A lacrosse training device 100 for use by a lacrosse player to practice checking an offensive player according to the present invention will now be described in detail with reference to FIGS. 1 through 5 of the accompanying drawings.

Figure 1:
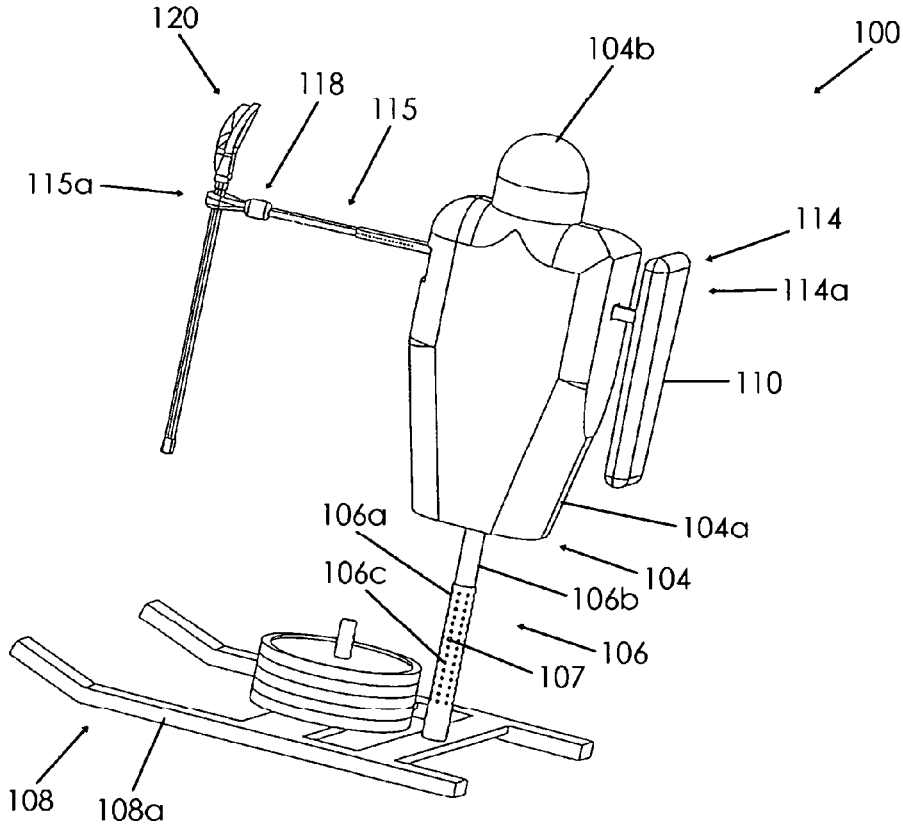
FIG. 1 is a perspective view of a lacrosse training device according to a preferred embodiment of the present invention.

As shown in FIG. 1, the lacrosse training device 100 includes a main post 104, a base 108, an activating member 114, and an arm 115. The main post 104 may extend generally vertically from the base 108 and include a torso region 104*a* and a head region 104*b* to represent the offensive player and separate a user from a lacrosse stick 120 described below. The main post 104 may include a height adjusting system 106 to selectively adjust a height of the arm 115, the activating member 114, and the main post 104. By selectively adjusting these heights, users of various heights may utilize the lacrosse training device 100. While the total length of the main post 104 is typically between five feet and six and a half feet in height, the total length can alternately be more or less.

Figure 2:
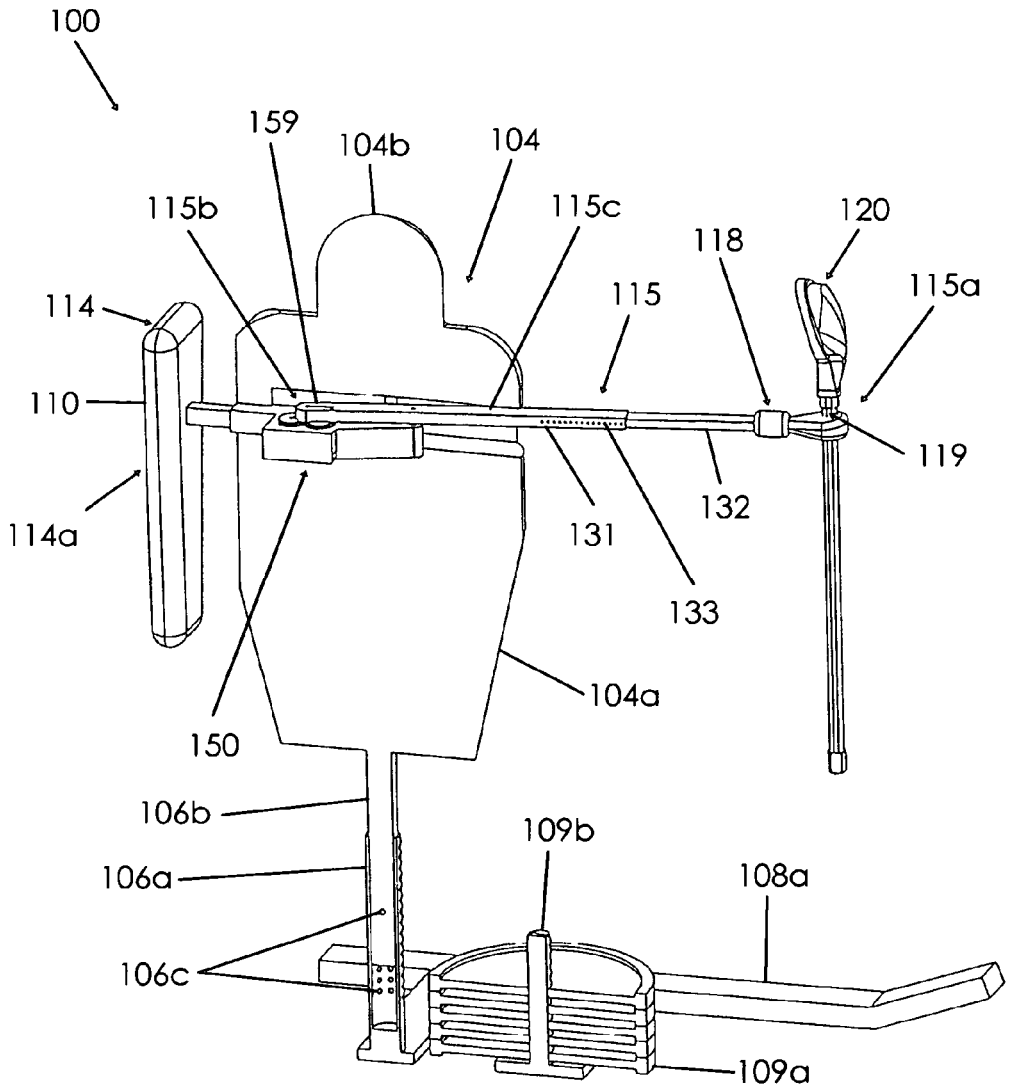
FIG. 2 is a fragmentary view of the lacrosse training device as in FIG. 1 illustrating the internal mechanical assemblies of the device.

The height adjusting system 106 shown in FIGS. 1 and 2 includes a locking pin 107 and an outer member 106*a* and an inner member 106*b* of the main post 104. The inner member 106*b* is inwardly adjacent the outer member 106*a* in a telescoping configuration. Both the outer member 106*a* and the inner member 106*b* define at least one adjustment hole 106*c*, and at least one of the outer member 106*a* and the inner member 106*b* defines a plurality of adjustment holes 106*c*. The locking pin 107 is selectively positionable in the adjustment holes 106*c* to respectively maintain the inner member 106*b* and the outer member 106*a* at a plurality of preselected telescoping positions. In other words, by being positioned in the various adjustment holes 106*c*, the locking pin 107 can maintain the main post 104, the activating member 114, and the arm 115 at various heights. It should be understood that other height adjusting systems 106 may alternately or additionally be used, such as those that use a frictional clamp or other fastener to maintain relative positions of the inner and outer members 106*b*, 106*a*.

The base 108 may include at least one runner 108*a* to slide the main post 104 in a generally horizontal direction. Means for adjusting a weight of the base 108 may be included, such as removable weights 109*a* selectively coupled to a receiving element 109*b*. By adjusting the weight of the base 108, a user may determine how much force is necessary to slide the main post 104 using the runner(s) 108*a*.

The arm 115 may be operatively coupled to the main post 104 and extend outwardly from the main post 104. The arm 115 includes a distal end 115*a* and a proximal end 115*b* and is rotatable about a fixed point 115*c* between the distal end 115*a* and the proximal end 115*b* (FIG. 2). Means for holding a lacrosse stick 120 adjacent the distal end 115*a* of the arm 115 (such as a through hole 119 or a clamping mechanism, for example) and/or a lacrosse stick 120 may be included. The lacrosse stick 120 may be any regular lacrosse stick, such as those available commercially, and by being removable from the arm 115, a user may practice defending different types of lacrosse sticks 120 or various users (e.g., men, women, adults, children) may incorporate an appropriate lacrosse stick 120 and utilize the lacrosse training device 100. The arm 115 may include a flexible wrist 118 adjacent the distal end of the arm 115. The flexible wrist 118 may include a resilient material (e.g., a spring, rubber material, etc.) that allows irregular three-dimensional movement of the lacrosse stick 120 upon movement of the arm 115 by an actuator 150 described below.

Means for selectively adjusting a length of the arm 115 may be included. For example, as shown in FIG. 2, the arm 115 may include an outer member 131, an inner member 132, and a locking pin (not shown). The inner member 132 is inwardly adjacent the outer member 131 in a telescoping configuration. The outer member 131 may define at least one adjustment hole 133, the inner member 132 may define at least one adjustment hole (not shown), and at least one of the outer member 131 and the inner member 132 defines a plurality of adjustment holes 133. The locking pin (not shown) is selectively positionable in the adjustment holes in the inner and outer members 132, 131 to respectively maintain the inner member 132 and the outer member 131 at a plurality of preselected telescoping positions. In other words, by being positioned in the various adjustment holes, the locking pin can maintain the arm 115 at various lengths so that users of different sizes can utilize the training device 100 and so that users can practice against offensive players of various sizes. It should be understood that other length adjusting systems and devices may alternately or additionally be used, such as those that use a frictional clamp or other fastener to maintain relative positions of the inner and outer members 132, 131.

The activating member 114 may be operatively coupled to the main post 104 and extend outwardly from the main post 104, and the activating member 114 may be configured to separate a user from the distal end 115*a* of the arm 115. The activating member 114 may have an outer end 114*a* and include a generally vertical padded wall 110 adjacent the outer end 114*a*. While the padded wall 110 is shown to be planar in FIGS. 1 and 2, it may alternately be curved, parabolic, or another appropriate shape.

Figure 3:
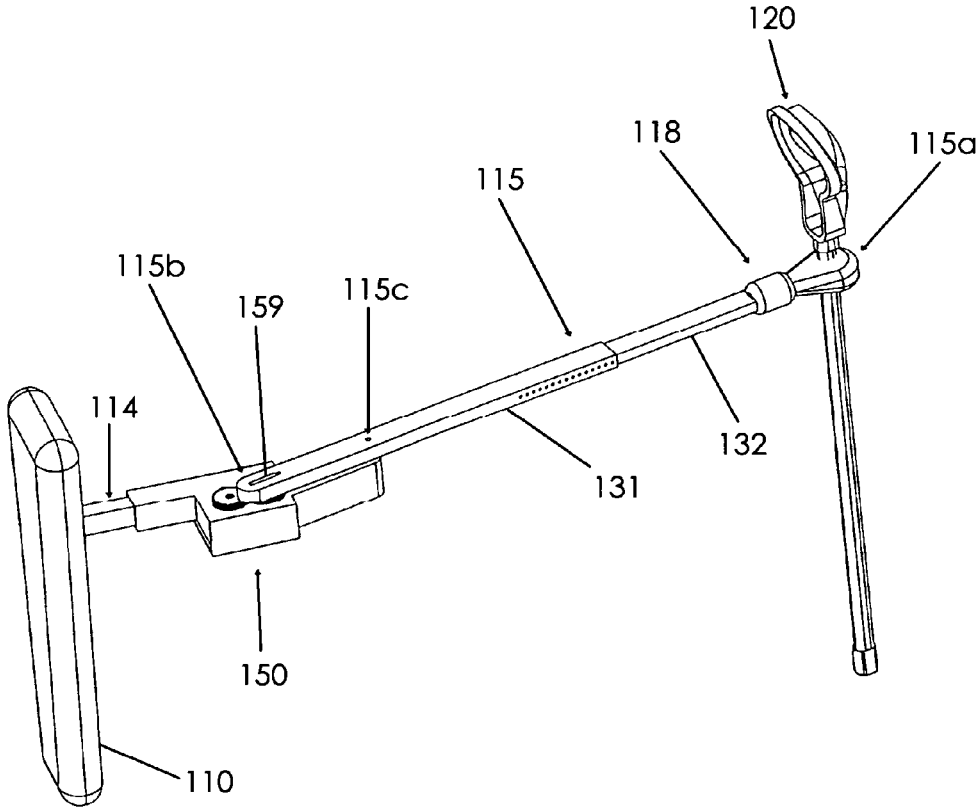
FIG. 3 is a perspective view of the lacrosse training device as in FIG. 1 with the activating member, arm, and lacrosse stick removed from the base and main post.
Figure 4:
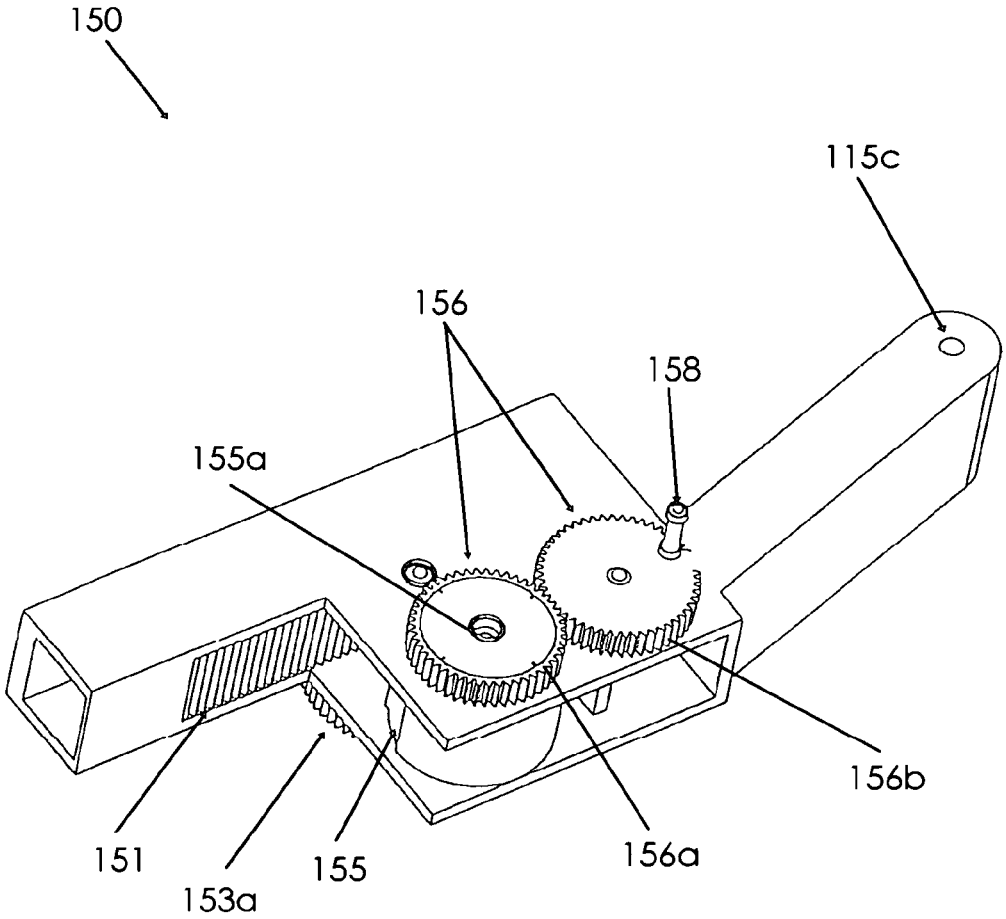
FIG. 4 is a perspective view on an enlarged scale of the actuator as in FIG. 2.
Figure 5:
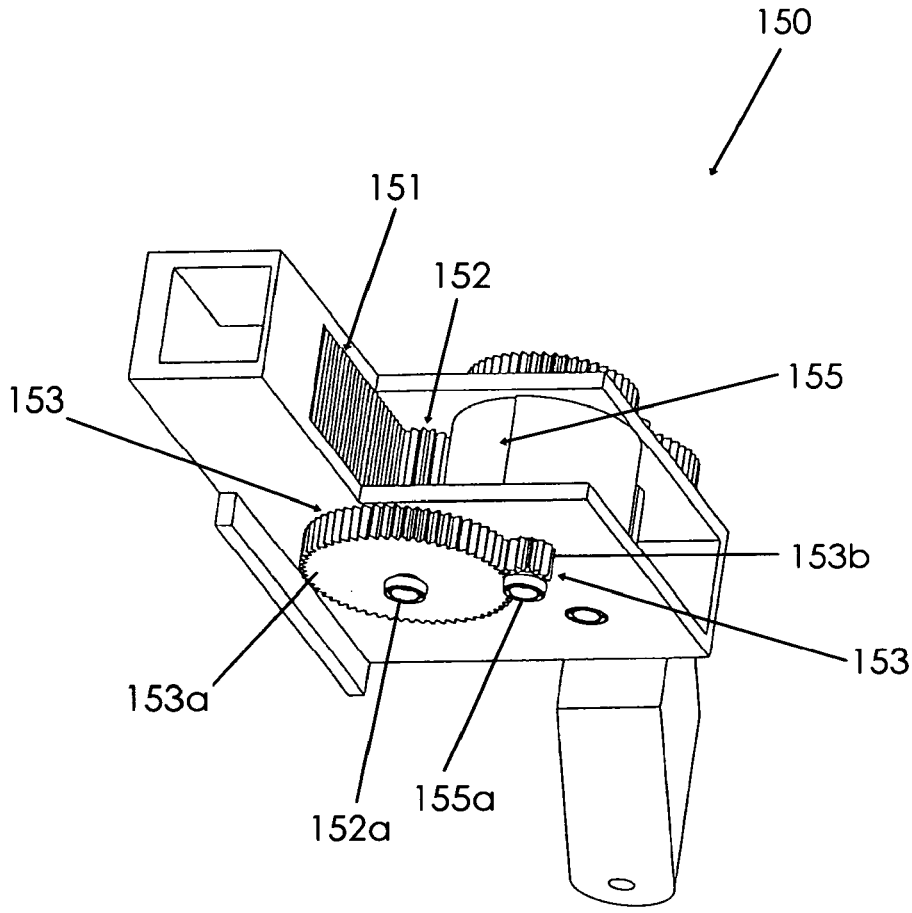
FIG. 5 is a perspective view from another angle of the actuator as in FIG. 4.

An actuator 150 is shown in FIGS. 2 and 3 and in detail in FIGS. 4 and 5. The actuator 150 is operatively coupled to the proximal end 115*b* of the arm 115 and to the activating member 114 so that (as described in detail below), the actuator 150 translates linear movement of the activating member 114 (e.g., movement of the padded wall 110 toward the main post 104) into non-linear movement of the arm 115. The actuator may include a rack gear 151 defined by the activating member 114 and a pinion gear 152 having a configuration complementary to a configuration of the rack gear 151. The pinion gear 152 may be positioned such that linear movement of the rack gear 151 in a first direction (e.g., due to movement of the padded wall 110 toward the main post 104) causes rotational movement of the pinion gear 152 in a first direction.

A spiral spring 155 is operatively coupled to the pinion gear, either directly or through one or more transfer gears 153, so that rotational movement of the pinion gear 152 in the first direction causes the spiral spring 155 to move from a biased (unwound) configuration to a wound configuration. For example, FIG. 5 shows a first transfer gear 153*a* sharing an axis of rotation 152*a* with the pinion gear 152 and a second transfer gear 153*b* (also referred to herein as an input gear) sharing an axis of rotation 155*a* with the spiral spring 155 to transfer the rotational movement of the pinion gear 152 in the first direction to the spiral spring 155.

A cam 158 (FIG. 4) is operatively coupled to the spiral spring 155, either directly or through one or more transfer gears 156, and movement of the spiral spring 155 from the wound configuration to the biased (unwound) configuration causes movement of the cam 158. For example, FIG. 4 shows a first transfer gear 156*a* (also referred to herein as an output gear) sharing the axis of rotation 155*a* with the spiral spring 155 and a second transfer gear 156*b* fixedly coupled to the cam 158 to transfer the movement of the spiral spring 155 from the wound configuration to the biased (unwound) configuration to the cam 158. An internal recess 159 may be defined by the proximal end 115*b* of the arm 115 as shown in FIG. 3, and the internal recess 159 may house the cam 158 so that movement of the cam 158 causes the arm 115 to pivot about the fixed point 115*c* in an oscillating manner. The output gear 156*a* may be a ratchet gear that does not transfer the movement of the spiral spring 155 from the biased configuration to the wound configuration to the cam 158; this may better allow the transfer gears 156 to be designed to appropriately oscillate the arm 115 using the forces derived from the unwinding of the spring 155.

In use, a user may adjust the height of the main post 104, the activating member 114, and the arm 115 as described above; the length of the arm 115 as described above; and the weight of the base 108 as described above. The user may then push the activating member 114 toward the main post 104, causing the rack gear 151 to move linearly and the pinion gear 152 to rotate. As described above, rotation of the pinion gear 152 may directly or indirectly cause the spiral spring 155 to move from a biased (unwound) configuration to a wound configuration. When the activating member 114 is released, the spring 155 may move toward the biased (unwound) configuration and cause the cam 158 to move as described above. Movement of the cam 158 may cause the arm 115 to rotate about the fixed point 115*c*, and movement of the arm 115 may cause the wrist 118 to move the lacrosse stick 120 in irregular three-dimensional movement as well as in oscillation with the arm 115. The user may stand adjacent the activating member 114 and reach around the activating member 114 and the main post 104 with a lacrosse stick to practice checking an offensive player, and more particularly to practice contacting the lacrosse stick 120 until the energy from the spring 155 is dissipated.

It is understood that while certain forms of this invention have been illustrated and described, it is not limited thereto except insofar as such limitations are included in the following claims and allowable functional equivalents thereof.

The invention claimed is:

1. A training device for use by a lacrosse player to practice checking an offensive player, comprising:

a base;

a main post extending generally vertically from said base;

an arm operatively coupled to said main post and extending outwardly therefrom, said arm having a distal end and a proximal end, said arm being rotatable about a fixed point between said distal end and said proximal end;

means for holding a lacrosse stick adjacent said distal end of said arm;

an activating member operatively coupled to said main post and extending outwardly therefrom, said activating member being configured to separate a user from said distal end of said arm;

an actuator operatively coupled to said arm proximal end and said activating member, wherein said actuator translates linear movement of said activating member into non-linear movement of said arm, wherein said actuator includes:

a rack gear defined by said activating member;

a pinion gear having a configuration complementary to a configuration of said rack gear, linear movement of said rack gear in a first direction causing rotational movement of said pinion gear in a first direction;

a spiral spring operatively coupled to said pinion gear, said rotational movement of said pinion gear in said first direction causing said spiral spring to move from a biased configuration to a wound configuration;

a cam operatively coupled to said spiral spring, movement of said spiral spring from said wound configuration to said biased configuration causing movement of said cam; and an internal recess defined by said proximal end of said arm, said internal recess housing said cam, said movement of said cam causing said arm to pivot about said fixed point in an oscillating manner.

2. The training device for use by a lacrosse player to practice checking an offensive player as in claim 1, wherein:

said activating member has an outer end; and said activating member includes a generally vertical padded wall adjacent said outer end of said activating member.

3. The training device for use by a lacrosse player to practice checking an offensive player as in claim 1, wherein said arm includes a flexible wrist adjacent said distal end of said arm, said flexible wrist including a resilient material allowing irregular three-dimensional movement of said distal end of said arm upon movement of said arm by said actuator.

4. The training device for use by a lacrosse player to practice checking an offensive player as in claim 1, wherein:

an input gear is operatively coupled to said spiral spring and operatively coupled to said pinion gear for transferring said rotational movement of said pinion gear in said first direction to said spiral spring; and an output gear is operatively coupled to said spiral spring and operatively coupled to said cam for transferring said movement of said spiral spring from said wound configuration to said biased configuration to said cam.

5. The training device for use by a lacrosse player to practice checking an offensive player as in claim 1, wherein said output gear is a ratchet gear that does not transfer said movement of said spiral spring from said biased configuration to said wound configuration to said cam.

6. The training device for use by a lacrosse player to practice checking an offensive player as in claim 1, wherein:

said activating member has an outer end;

said activating member includes a generally vertical padded wall adjacent said outer end of said activating member; and movement of said padded wall toward said main post causes said linear movement of said rack gear in said first direction.

7. The training device for use by a lacrosse player to practice checking an offensive player as in claim 1, wherein said arm includes a flexible wrist adjacent said distal end of said arm, said flexible wrist including a resilient material allowing irregular three-dimensional movement of said distal end of said arm upon movement of said arm by said actuator.

8. The training device for use by a lacrosse player to practice checking an offensive player as in claim 1, wherein said arm includes a flexible wrist adjacent said distal end of said arm, said flexible wrist including a resilient material allowing irregular three-dimensional movement of said distal end of said arm upon movement of said arm by said actuator.

9. The training device for use by a lacrosse player to practice checking an offensive player as in claim 1, further comprising means for adjusting a weight of said base.

10. The training device for use by a lacrosse player to practice checking an offensive player as in claim 1, wherein said base includes at least one runner to slide said main post in a generally horizontal direction.

11. The training device for use by a lacrosse player to practice checking an offensive player as in claim 1, wherein said main post defines a torso region and a head region representing the offensive player.

12. The training device for use by a lacrosse player to practice checking an offensive player as in claim 1, wherein said main post includes a height adjusting system to selectively adjust a height of said arm, said activating member, and said main post.

13. The training device for use by a lacrosse player to practice checking an offensive player as in claim 1, wherein:

said main post comprises an outer member, an inner member, and a locking pin;

said outer member defines at least one adjustment hole;

said inner member defines at least one adjustment hole;

at least one of said outer member and said inner member defines a plurality of adjustment holes;

said inner member is inwardly adjacent said outer member in a telescoping configuration; and said locking pin is selectively positionable in said adjustment holes to respectively maintain said inner member and said outer member at a plurality of preselected telescoping positions.

14. The training device for use by a lacrosse player to practice checking an offensive player as in claim 1, wherein:

said arm comprises an outer member, an inner member, and a locking pin;

said outer member defines at least one adjustment hole;

said inner member defines at least one adjustment hole;

at least one of said outer member and said inner member defines a plurality of adjustment holes;

said inner member is inwardly adjacent said outer member in a telescoping configuration; and said locking pin is selectively positionable in said adjustment holes to respectively maintain said inner member and said outer member at a plurality of preselected telescoping positions.

15. The training device for use by a lacrosse player to practice checking an offensive player as in claim 1, further comprising means for selectively adjusting a length of said arm.

16. A training device for use by a lacrosse player to practice checking an offensive player, comprising:

a base;

a main post extending generally vertically from said base;

an arm operatively coupled to said main post and extending outwardly therefrom, said arm having a distal end and a proximal end, said arm being rotatable about a fixed point between said distal end and said proximal end;

a lacrosse stick adjacent said distal end of said arm;

an activating member operatively coupled to said main post and extending outwardly therefrom, said activating member having an outer end and including a generally vertical padded wall adjacent said activating member outer end;

an actuator operatively coupled to said arm proximal end and said activating member, wherein said actuator translates linear movement of said activating member padded wall toward said main post into non-linear movement of said arm;

wherein said arm includes a flexible wrist adjacent said distal end of said arm, said flexible wrist including a resilient material allowing irregular three-dimensional movement of said lacrosse stick upon movement of said arm by said actuator;

wherein said actuator includes:

a rack gear defined by said activating member;

a pinion gear having a configuration complementary to a configuration of said rack gear, linear movement of said rack gear in a first direction causing rotational movement of said pinion gear in a first direction;

a spiral spring operatively coupled to said pinion gear, said rotational movement of said pinion gear in said first direction causing said spiral spring to move from a biased configuration to a wound configuration;

a cam operatively coupled to said spiral spring, movement of said spiral spring from said wound configuration to said biased configuration causing movement of said cam; and an internal recess defined by said proximal end of said arm, said internal recess housing said cam, said movement of said cam causing said arm to pivot about said fixed point in an oscillating manner.

17. The training device for use by a lacrosse player to practice checking an offensive player as in claim 16, wherein:

an input gear is operatively coupled to said spiral spring and operatively coupled to said pinion gear for transferring said rotational movement of said pinion gear in said first direction to said spiral spring;

an output gear is operatively coupled to said spiral spring and operatively coupled to said cam for transferring said movement of said spiral spring from said wound configuration to said biased configuration to said cam; and said output gear is a ratchet gear that does not transfer said movement of said spiral spring from said biased configuration to said wound configuration to said cam.

18. The training device for use by a lacrosse player to practice checking an offensive player as in claim 16, wherein:

said main post includes a torso region and a head region representing the offensive player and separating a user from said lacrosse stick;

said base includes at least one runner to slide said main post in a generally horizontal direction;

said device further comprises means for adjusting a weight of said base; and said device further comprises means for selectively adjusting a length of said arm.

* * * * *